US007220074B2

(12) United States Patent
Tsaur

(10) Patent No.: US 7,220,074 B2
(45) Date of Patent: May 22, 2007

(54) SLENDER CONTAINER

(76) Inventor: Garry Tsaur, 19222 Tranbarger St., Rowland Heights, CA (US) 91748

( * ) Notice: Subject to any disclaimer, the term of this patent is extended or adjusted under 35 U.S.C. 154(b) by 0 days.

(21) Appl. No.: 10/404,554

(22) Filed: Apr. 1, 2003

(65) Prior Publication Data

US 2005/0265768 A1 Dec. 1, 2005

(51) Int. Cl.

| | |
|---|---|
| ***B43K 5/14*** | (2006.01) |
| ***A46B 11/00*** | (2006.01) |
| ***B05C 1/00*** | (2006.01) |
| ***A61M 35/00*** | (2006.01) |
| ***B65D 47/00*** | (2006.01) |

(52) U.S. Cl. ..... 401/133; 401/132; 401/123; 401/17; 604/3; 222/547; 222/564

(58) Field of Classification Search ..... 401/34, 401/132, 133, 205, 261, 263, 17, 123; 604/3; 222/547, 564, 541.1

See application file for complete search history.

(56) References Cited

U.S. PATENT DOCUMENTS

| | | | | |
|---|---|---|---|---|
| 2,974,350 | A * | 3/1961 | Schwartzman | 401/206 |
| 3,123,258 | A * | 3/1964 | Schiltz | 222/215 |
| 3,584,211 | A * | 6/1971 | Rauhut | 362/34 |
| 4,795,156 | A * | 1/1989 | Paulish | 401/35 X |
| 4,936,498 | A * | 6/1990 | Pirila | 222/420 |
| 4,952,204 | A * | 8/1990 | Korteweg | 604/1 |
| 5,927,884 | A * | 7/1999 | Kao | 401/132 |
| 6,682,242 | B1 * | 1/2004 | Montoli | 401/18 |

* cited by examiner

*Primary Examiner*—David J. Walczak
(74) *Attorney, Agent, or Firm*—Joe Nieh

(57) ABSTRACT

A small slender container that may be used to store small quantity of fluid, such as perfume, in a sealed environment and easily dispenses the fluid as desired is disclosed. The content of the slender container is completely sealed and will not leak or evaporate from the container. The slender container is a small diameter slender container with a member affixed within the slender container. The member affixed within the slender container disrupts the surface tension of the perfume and allows the content to flow easily from the small diameter slender container. The slender container can be used as the body of a swab applicator and also for storing fluids wherein the fluid in the slender container may be released into a brush or an absorbent material attached to the ends of the swab applicator when desired.

14 Claims, 1 Drawing Sheet

SLENDER CONTAINER

BACKGROUND—FIELD OF INVENTION

The present invention relates to a small sealed container. More specifically, the present invention relates to a small slender sealed container that may be used to store and dispense fluids such as perfumes.

BACKGROUND—DESCRIPTION OF RELATED ART

Small containers in the general form of an elongated tube are generally used to distribute small perfume samples to consumers. Such containers are usually made as small as possible because the perfume samples are expensive and only a very small amount is necessary. However, due to the low specific gravity and the high capillary action of the perfume, there is a limitation to how small of a diameter of the container may be used and still allow the perfume to be dispensed from the container.

If the diameter of the container is too small, the perfume cannot be dispensed from the container due to the capillary action of the fluid. If the diameter of the container is large, the perfume in the container can be easily dispensed. However, since the perfume is expensive and only a very small amount is necessary for a sample, a large diameter container is not economical or practical.

There is a point where the diameter of the container is made as small as possible and yet still allows the perfume in the container to be dispensed with ease. Most perfume sample containers are made with diameters at this minimum diameter. However, even at this minimum diameter, the perfume container is still too large and not economical for dispensing perfume samples. Much more perfume than necessary for a sample must still be filled in the container or the container will have a large void that appears to be left from evaporated perfumes.

Although a smaller diameter container is desirable, it has not been possible due to the physical phenomenon of capillary action of the perfume that limits how small a diameter the container may have. The present invention is a simple yet effective means to allow a very small diameter container to be used for dispensing minute amount of perfume samples efficiently and economically.

SUMMARY OF THE INVENTION

The present invention is a small slender container that may be used to store small quantity of fluid, such as perfume, in a sealed environment and easily dispenses the fluid as desired. The content of the slender container is completely sealed and will not leak or evaporate from the container. The slender container is a small diameter slender container with a member affixed within the slender container. The member affixed within the slender container disrupts the surface tension of the perfume and allows the content to flow easily from the small diameter slender container. The slender container can be used as the body of a swab applicator and also for storing fluids wherein the fluid in the slender container may be released into the absorbent material attached to the ends of the swab applicator when desired.

DETAILED DESCRIPTION OF THE PREFERRED EMBODIMENT

Figure 1:
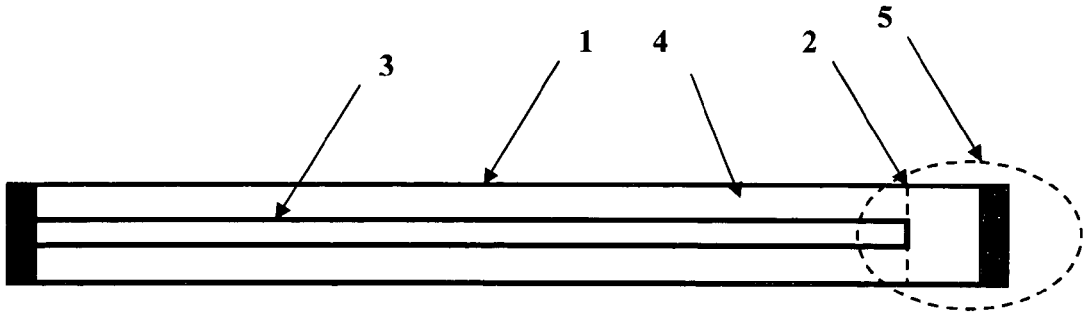
FIG. 1 shows the preferred embodiment of the slender container.

FIG. 1 shows the preferred embodiment of the slender container. The slender container has an elongated housing 1 with two ends that are sealed. An opening means 2 in the form of a score on the slender container is located near one end. An elongated member 3 with a smaller diameter and shorter length than the elongated housing 1 is inserted into the elongated housing 1 and attached to the sealed end opposite the end near the opening means of the elongated housing 1. The elongated member 3 may optionally be a hollow tube. A fluid 4 is sealed within the elongated housing 1 until released through the opening means 2. When the slender container is opened by the opening means 2, the fluid 4 in the slender container is exposed and any physical contact, such as with the user's skin or with an absorbent material such as cotton, with the exposed fluid 4 will release the fluid 4 from the slender container.

An applicator tip 5 made of an absorbent material such as a cotton ball may be attached to the end of the slender container enclosing the opening means 2. When the slender container is opened by the opening means 2, the fluid 4 in the slender container will flow directly into and be absorbed by the applicator tip 5 for application. The applicator tip 5 may also be a sponge or a brush.

Figure 2:
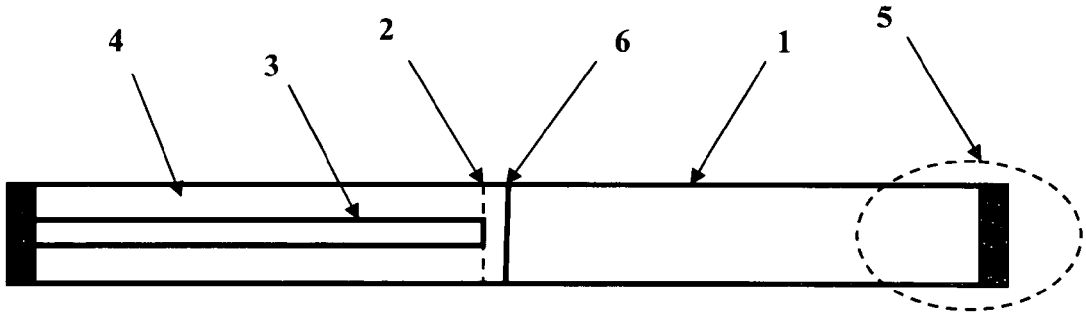
FIG. 2 shows another embodiment of the slender container with an applicator tip on one end.

FIG. 2 shows another embodiment of the slender container wherein the elongated housing 1 is divided into two compartments by a divider 6. In the first compartment, an opening means 2 in the form of a score on the slender container is located near one end of said first compartment. An elongated member 3 with a smaller diameter and shorter length than said first compartment is attached within said first compartment to the sealed end opposite the end near the opening means 2 of said compartment. A fluid 4 is sealed within said first compartment, surrounding the elongated member 3, until released through the opening means 2. An absorbent material such as a cotton ball is attached to the second end of the other compartment opposite the end where the elongated member 3 attaches. When the slender container is opened by the opening means 2, the fluid 4 in the slender container is exposed and when the absorbent material at the end of the second compartment is brought into contact with the exposed fluid 4, the fluid 4 will be released into the absorbent material.

Figure 3:
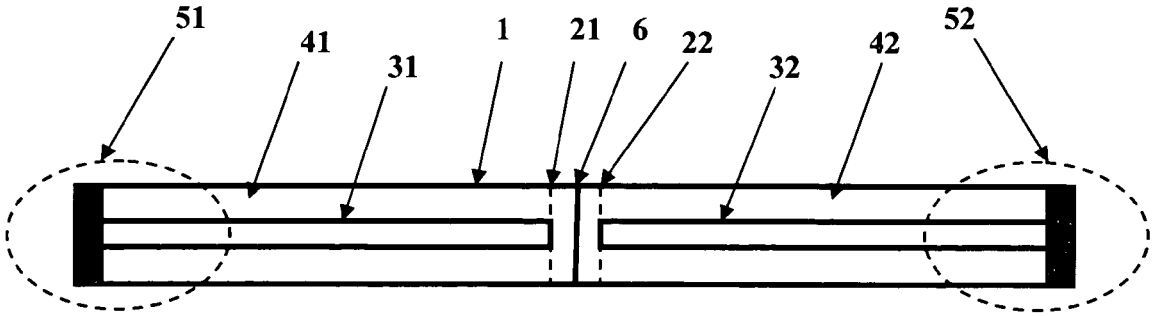
FIG. 3 shows another embodiment of the slender container with an applicator tip on both ends.

FIG. 3 shows another embodiment of the slender container wherein the elongated housing 1 is divided into two compartments by a divider 6. In the first compartment, a first opening means 21 in the form of a score on the slender container is located near one end of said first compartment. A first elongated member 31 with a smaller diameter and shorter length than said first compartment is attached within said first compartment to the sealed end opposite the end near the first opening means 21 of said first compartment. A first fluid 41 is sealed within said first compartment, surrounding the first elongated member 31, until released through the first opening means 21. A first applicator tip 51 made of absorbent material such as a cotton ball is attached to the sealed end of said first compartment where the first elongated member 31 attaches.

In the second compartment, a second opening means 22 in the form of a score on the slender container is located near one end of said second compartment near the first opening means 21 of the first compartment. A second elongated member 32 with a smaller diameter and shorter length than said second compartment is attached within said second compartment to the sealed end opposite the end near the second opening means 22 of said second compartment. A second fluid 42 is sealed within said second compartment, surrounding the second elongated member 32, until released through the second opening means 22. A second applicator tip 52 made of absorbent material such as a cotton ball is attached to the sealed end of said second compartment where the second elongated member 32 attaches.

When the slender container is opened by the first opening means 21, the first fluid 41 in the slender container is exposed and when the second applicator tip 53 made of absorbent material at the end of the second compartment is brought into contact with the exposed first fluid 41, the first fluid 41 will be released into the absorbent material 52. When the slender container is opened by the second opening means 22, the second fluid 42 in the slender container is exposed and when the first applicator tip 51 made of absorbent material at the end of the first compartment is brought into contact with the exposed second fluid 42, the second fluid 42 will be released into the absorbent material 51. The fluids 41, 42 in the two compartments may be of the same type of fluid or of different types of fluids.

The slender container of the present invention allows a small amount of fluid 4 that evaporates easily, such as perfumes, to be stored in a sealed environment to prevent evaporation. The fluid 4 may be released easily through the opening means 2 by simply breaking open the housing at the scoring to allow the fluid 4 to be exposed. Without the elongated member 3 in the present invention, the fluid 4 within the slender container will not be released from the slender container due to the small diameter of the slender container and the resulting capillary action surface tension and atmospheric pressure, which will prevent the exit of the fluids 4 from the slender container.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A slender container comprising:

a sealed substantially constant diameter elongated housing with one or more opening means;

an elongated member enclosed within and affixed to a sealed end of the sealed elongated housing and does not extend beyond the opening means; and a fluid disposed within said sealed elongated housing surrounding the elongated member;

wherein the opening means is disposed closer to an end of the elongated member that is not affixed to the elongated housing than the end of the elongated member that is affixed to the elongated housing and wherein the elongated housing is dimensioned such that the surface tension of the fluid will not allow the fluid to move within the elongated housing without said elongated member thereby the slender container may be used to store and dispense a small amount of fluid through the opening means.

2. A slender container as in claim 1, wherein the opening means is a scoring that can be broken open to release the fluid in the slender container.

3. A slender container as in claim 1, wherein the fluid is perfume.

4. A slender container as in claim 1, wherein the elongated member is a hollow tube.

5. A slender container comprising:

a sealed substantially constant diameter elongated housing with a first compartment and a second compartment adjacent to each other, without enclosing the other compartment, with an opening means at one end of said first compartment;

an elongated member enclosed within said first compartment and affixed to a sealed end of said first compartment of the sealed elongated housing and does not extend substantially beyond the opening means after the elongated housing is opened through the opening means; and a fluid disposed within said first compartment surrounding the elongated member;

wherein the opening means is disposed closer to an end of the elongated member that is not affixed to the elongated housing than the end of the elongated member that is affixed to the elongated housing and wherein the slender container may be used to store and dispense a small amount of fluid through the opening means.

6. A slender container as in claim 5, wherein the opening means is a scoring that can be broken open to release the fluid in the slender container.

7. A slender container as in claim 5, wherein the fluid is perfume.

8. A slender container as in claim 5, wherein the elongated member is a hollow tube.

9. A slender container as in claim 5, wherein an applicator tip encloses the end of the second compartment opposite the first compartment.

10. A slender container comprising:

a sealed elongated housing with a first compartment and a second compartment with a first opening means at one end of said first compartment and a second opening means at one end of said second compartment near the first compartment;

a first elongated member enclosed within said first compartment and affixed to one end of said first compartment of the sealed elongated housing opposite the second compartment;

a second elongated member enclosed within said second compartment and affixed to one end of said second compartment of the sealed elongated housing opposite the first compartment;

a first fluid disposed within said first compartment; and a second fluid disposed within said second compartment;

wherein the slender container may be used to store and dispense a small amount of fluid through the opening means.

11. A slender container as in claim 10, wherein the first and second opening means are scorings that can be broken open to release the fluids in the slender container.

12. A slender container as in claim 10, wherein said fluids are perfume.

13. A slender container as in claim 10, wherein the first elongated member and the second elongated members are hollow tubes.

14. A slender container as in claim 10, wherein a first applicator tip encloses the end of the first compartment opposite the second compartment and a second applicator tip encloses the end of the second compartment opposite the first compartment.

* * * * *